US011407955B2

(12) United States Patent
Galvin

(10) Patent No.: US 11,407,955 B2
(45) Date of Patent: Aug. 9, 2022

(54) METHOD OF AGGLOMERATING FINE PARTICLES USING A CONCENTRATED WATER IN OIL EMULSION

(71) Applicant: The University of Newcastle, Callaghan (AU)

(72) Inventor: Kevin Patrick Galvin, Callaghan (AU)

(73) Assignee: The University of Newcastle, Callaghan (AU)

( * ) Notice: Subject to any disclaimer, the term of this patent is extended or adjusted under 35 U.S.C. 154(b) by 0 days.

(21) Appl. No.: 14/374,454

(22) PCT Filed: Jan. 25, 2013

(86) PCT No.: PCT/AU2013/000070

§ 371 (c)(1),
(2) Date: Jul. 24, 2014

(87) PCT Pub. No.: WO2013/110142

PCT Pub. Date: Aug. 1, 2013

(65) Prior Publication Data

US 2014/0360094 A1 Dec. 11, 2014

(30) Foreign Application Priority Data

Jan. 25, 2012 (AU) ..... 2012900281

(51) Int. Cl.
*C10L 1/32* (2006.01)
*C10L 5/22* (2006.01)
(Continued)

(52) U.S. Cl.
CPC ..... *C10L 5/22* (2013.01); *C10L 1/324* (2013.01); *C10L 5/14* (2013.01); *C10L 5/363* (2013.01); *C10L 5/366* (2013.01)

(58) Field of Classification Search
CPC ..... C10L 1/32; C10L 5/22; C10L 1/324
See application file for complete search history.

(56) References Cited

U.S. PATENT DOCUMENTS 4,173,533 A * 11/1979 Williams ..... B01D 17/0205 210/747.5
4,343,730 A * 8/1982 Becker ..... B03D 1/016 526/923

(Continued)

OTHER PUBLICATIONS

International Search Report prepared by the Australian Patent Office dated Mar. 7, 2013, for International Application No. PCT/AU2013/000070.

(Continued)

*Primary Examiner* — Ellen M McAvoy
*Assistant Examiner* — Ming Cheung Po
(74) *Attorney, Agent, or Firm* — Marshall, Gerstein & Borun LLP

(57) ABSTRACT

A method of agglomerating fine particles such as ultrafine coal in a beneficiation process, uses a water in oil emulsion to significantly reduce the amount of oil needed compared with known oil in water emulsions. A solution of oil and emulsifying agent is provided to which water is progressively added forming a concentrated water in oil emulsion with stabilized water drops (1) packed inside the oil solution phase (2). Fine particles in a slurry are then added, causing the fine particles to collide and stick to the emulsion particles. An optional form of the invention coats tiny portions of the emulsion in a thin film of low viscosity oil (5) to achieve a higher level of selectivity.

20 Claims, 1 Drawing Sheet

(51) Int. Cl.
*C10L 5/14* (2006.01)
*C10L 5/36* (2006.01)

(56) References Cited

U.S. PATENT DOCUMENTS 4,560,482 A * 12/1985 Canevari ..... B01F 17/00 210/749
4,624,763 A * 11/1986 Chimenti ..... B01D 11/04 204/562
4,692,237 A * 9/1987 Hsu ..... C10G 1/045 210/729
4,734,206 A * 3/1988 Clayfield ..... B03B 9/005 209/5
4,985,250 A * 1/1991 Bee ..... A23G 3/346 424/401
5,087,293 A 2/1992 Keough et al.
9,789,492 B2 * 10/2017 Yoon ..... C10L 5/366
2003/0228339 A1 * 12/2003 El-Nokaly ..... A61K 8/044 424/401

OTHER PUBLICATIONS

Written Opinion prepared prepared by the Australian Patent Office dated Mar. 7, 2013, for International Application No. PCT/AU2013/000070.
Response to the Written Opinion prepared dated Nov. 22, 2013, for International Application No. PCT/AU2013/000070.
International Preliminary Report on Patentability prepared by the Australian Patent Office dated May 8, 2014, for International Application No. PCT/AU2013/000070.

* cited by examiner

METHOD OF AGGLOMERATING FINE PARTICLES USING A CONCENTRATED WATER IN OIL EMULSION

CROSS REFERENCE TO RELATED APPLICATIONS

This application is a national stage application under 35 U.S.C. 371 and claims the benefit of PCT Application No. PCT/AU2013/000070 having an international filing date of Jan. 25, 2013, which designated the United States, which PCT application claimed the benefit of Australian Application No. 2012900281 filed Jan. 25, 2012, the disclosure of each of which are incorporated herein by reference.

FIELD OF THE INVENTION

This present invention relates to a method of agglomerating fine particles using concentrated water in oil emulsion and has been devised particularly though not solely for beneficiating and dewatering coal fines in tailings.

BACKGROUND OF THE INVENTION

Oil agglomeration is a powerful process for selectively growing particles of ultrafine coal (ca less than 0.5 millimetres) into small balls up to several millimetres in diameter, leaving behind ultrafine particles of clay and mineral matter. The fine coal is then easily dewatered using a screen, thus producing a clean coal product. This beneficiation technology was investigated extensively in the 1970s and shown to be effective on fine coal tailings. However, due to the significant cost of oil following the oil crisis in the 1970s the approach was abandoned as non-economical. Various efforts have been made since that time to agglomerate coal fines using oil, but the cost of the oil has always remained prohibitive.

These attempts have often involved the use of oil in water emulsions in an attempt to reduce the amount of oil needed. None have been successful in reducing the volume of oil required to a point where the process is economically viable.

SUMMARY OF THE INVENTION

The present invention therefore provides a method of agglomerating fine particles including the steps of:

providing a solution of oil and emulsifying agent, progressively adding water and dispersing the water into the said solution, and forming a concentrated water in oil emulsion with stabilized water drops packed inside the oil solution phase, and adding fine particles in a slurry, causing the fine particles to collide and stick to the emulsion particles.

Preferably, the method further comprises the step of adding the concentrated water in oil emulsion to a larger volume of agitated water until the concentrated water in oil emulsion is dispersed into the larger volume of water. More preferably, the concentrated water in oil emulsion is dispersed into smaller portions of concentrated water in oil emulsion surrounded by the larger volume of water.

Preferably, the fine particles are solid fine particles. In one form of the invention the solid fine particles are fine coal particles. In another form of the invention, the solid fine particles are mineral particles.

Alternatively, the fine particles are liquid particles. In one form, the liquid particles are drops, micro-drops or droplets. In another form, the liquid particles are oil drops, oil micro-drops or oil droplets.

Preferably, the concentrated water in oil emulsion has a water volume fraction greater than 0.75.

More preferably, the water volume fraction is greater than 0.9. In this embodiment, the concentrated water in oil emulsion is more viscous than either the water or oil solution. This material is oil-like and repels water so acts like a viscous, sticky, oil-like substance even though the material is largely water.

Preferably, the concentrated water in oil emulsion dispersed into the larger volume of water has an oil content less than 10% of the oil content used for conventional oil agglomeration.

Preferably, the agglomerated fine particles stuck to the emulsion particles are passed over a screen to dewater and/or deslime the agglomerates. In another form of the invention the fine particles stuck to the emulsion particles float to the surface of the water for easy removal.

In one form of the invention, tiny portions of the concentrated water in oil emulsion, which behave like viscous and sticky oil, are coated with a new thin film of low viscosity oil, reducing the stickiness while maintaining the hydrophobicity of the tiny portions of the concentrated water in oil emulsion. In another form of the invention, the tiny portions of the concentrated water in oil emulsion are coated before being added to the larger volume of agitated water.

Contrary to the prior art, the invention involves an alternative approach, which replaces the oil binder with a concentrated water in oil emulsion binder, thereby reducing the oil consumption.

BRIEF DESCRIPTION OF THE DRAWINGS

Notwithstanding any other forms that may fall within its scope, one preferred form of the invention will now be described by way of example only, with reference to the accompanying drawings, in which.

PREFERRED EMBODIMENTS OF THE INVENTION

The present invention defines an alternative to conventional (and expensive) oil agglomeration utilising a novel binding agent that reduces oil consumption by a factor of 10 to 20 fold. If conventional oil agglomeration requires 10 wt % oil (relative to the mass of solids) then the novel binding agent according to the invention would involve as little as 0.5 to 1 wt % oil. Although emulsions have been proposed for use in this situation in the past, they have been oil in water emulsions which have not been effective in reducing the amount of oil used to the point where it is economically viable. By way of contrast, in this invention, the proposed binding agent is a concentrated water in oil emulsion prepared by firstly forming a solution of diesel oil and emulsifying agent. Emulsifying agents include sorboton mono oleate. The oil based solution is added to a mixing vessel and water stirred in gradually. This may be done in any suitable vessel depending on the scale of operation although it is noted in laboratory tests that a kitchen mixer is quite effective in stirring the water gradually into the oil based solution.

Figure 2:
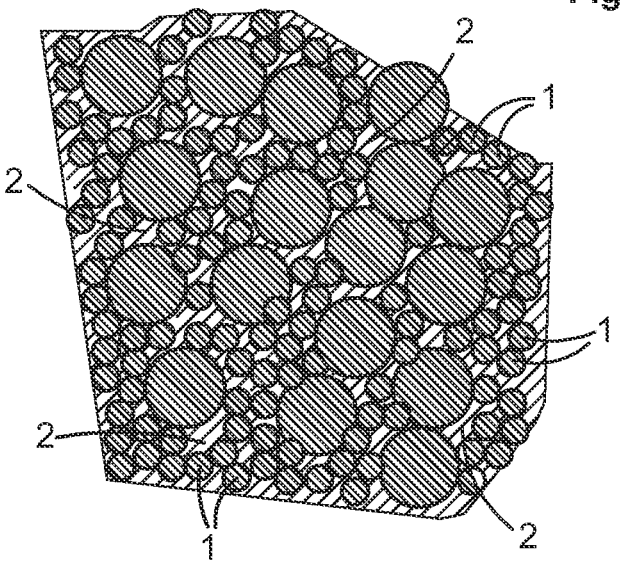
FIG. 2 is a diagrammatic representation of a concentrated water in oil emulsion, with stabilised water drops packed inside the oil phase according to the invention.

The water then disperses into the oil phase forming tiny drops of water as shown at 1 in FIG. 2, tightly packed inside the oil phase 2. This concentrated water in oil emulsion appears homogenous, having the appearance of "white goo".

The emulsion so formed always presents an oil like interface to the added water, and hence the water continues to disperse into the emulsion. While a typical concentrated packing fraction of equal sized spheres is 0.64 to 0.75, the water volume fraction in a concentrated water in oil emulsion can increase to 0.9 or even 0.95. The water drops develop a size distribution and deformation that permits this very tight fraction as illustrated in FIG. 2.

Thus, an oil phase volume of 10 mL is converted to a white and opaque emulsion of 100 to 200 mL. This hydrophobic emulsion, which contains water drops of a few microns, is highly viscous and exhibits a significant yield stress. The high viscosity makes the emulsion, hereinafter referred to in this specification as "emulsion goo", remarkably sticky.

In order to utilise the emulsion goo, a mixing tank is typically filled with water and agitated at a high speed of, for example, 1600 rpm. The emulsion goo is then added to the much larger volume of agitated water and hence dispersed into tiny portions of emulsion goo. These tiny portions of emulsion goo are very sticky. The mixing is continued until the white opaque emulsion goo, which is a concentrated water in oil emulsion, is dispersed. At this stage, tiny portions of the emulsion goo are suspended in the water by the rapid mixing.

Following the further addition of fine particles, which in this embodiment is in the form of solid fine coal particles contained in a coal and mineral matter slurry, the solid particles collide and stick to the tiny emulsion goo particles. Because of the significant volume of emulsion, the solid particles bind to form agglomerates, with the emulsion goo acting as a binding agent, providing the interstitial bulk between solid particles.

Figure 1:
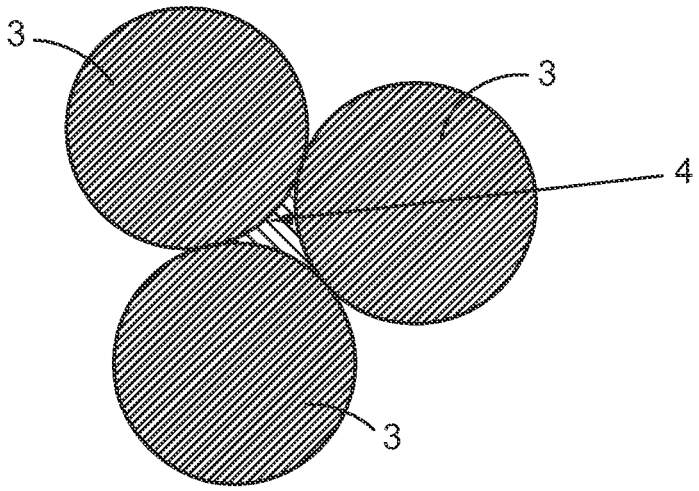
FIG. 1 is a diagrammatic enlarged view showing the volume of binding agent required in conventional (prior art) oil agglomeration technologies.

Agglomerated particles 3 are shown in FIG. 1 which also shows the zone 4 between the agglomerated particles requiring a binding agent for agglomeration. In the prior art, as represented in FIG. 1, the zone 4 needs to be completely filled with oil for agglomeration, but when using the novel binding agent according to the invention, the space between the particles is formed of the emulsion goo, a concentrated water in oil emulsion diagrammatically represented in FIG. 2, mainly water drops within thin films of the oil. The binding agent is hydrophobic and hence should selectively agglomerate with the hydrophobic coal, leaving behind the mineral matter.

It is noted however, that being very sticky, the concentrated water in oil emulsion is not as selective as pure oil. In this less selective case, the novel binding agent may provide an effective solution to achieving solid-liquid separation, allowing efficient water recovery, and formation of concentrated tailings. Thus the binding agent may solve a number of tailings problems in the mining industry.

Figure 3:
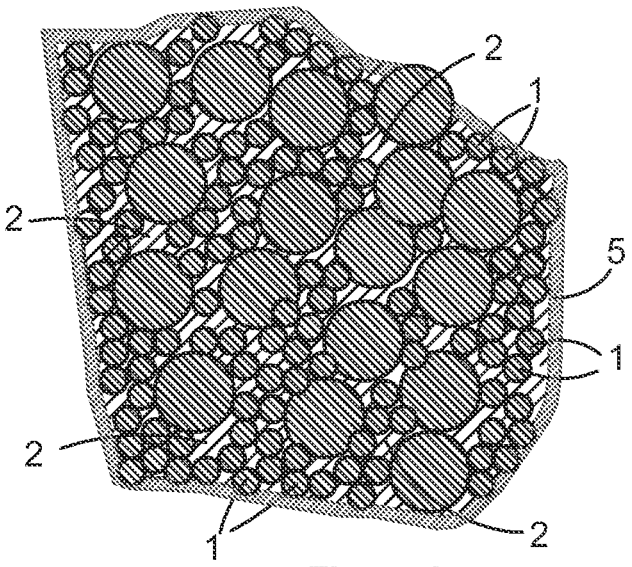
FIG. 3 is a similar view to FIG. 2, showing the optional coating of the novel binding agent with a thin film of low viscosity oil.

In a further form of the invention, in order to achieve a higher level of selectivity, the tiny portions of emulsion goo can be coated in a new thin film 5 of low viscosity oil as can be seen in FIG. 3. This is achieved by dispersing low viscosity oil in water, and dispersing the emulsion goo particles in water, and then mixing these two dispersions.

The oil drops collide with the tiny portions of the emulsion goo. The collisions between the oil and the emulsion goo result in adhesion and rapid wetting such that each of the tiny portions of the emulsion goo typically shown in FIG. 3, become coated with a thin film of lubricating oil 5. The lubricating oil reduces the stickiness and maintains the hydrophobicity of the binding agent.

This tiny portion of coated binding agent will selectively collide with the coal particles and hence act as a binding agent to produce agglomerates of fine coal.

When the coal and mineral matter slurry is added, the coal selectively attaches to the coated novel binding agent, and grows to form agglomerates. The clays and mineral matter fail to attach, and remain as fine slimes in the water. The large agglomerates then separate rapidly from the rest of the slurry. This separation may result in the agglomerates sometimes floating to the top of the water, facilitating easy removal. Whether or not the agglomerates float to the top, the agglomerates can be readily dewatered by passing them over a screen.

In this manner, the coal is successfully beneficiated using volumes of oil in the order of 1/10 to 1/20 of the volumes which have previously been required in prior art oil agglomeration processes. This results in an economically viable method of agglomerating fine coal particles which can be effectively used in cleaning up tailings in coal processing plants.

Although this invention has been described with reference to the agglomeration of fine coal particles, it will be appreciated that it can be applied to the agglomeration of other particles, such as mineral particles, liquid particles, particles of organic matter, or any combination thereof. In the case of liquid particles, they may be in the form of drops, micro-drops or droplets (ie. drops with an average diameter of less than 500 μm). For example, the invention can be readily applied to the agglomeration of oil micro-drops and droplets, where the goal is to clean up or purify contaminated water by removing these micro drops and droplets.

A hydrophobic binding agent as described above can be used to agglomerate hydrophobic particles and similarly a hydrophilic binding agent can be used to agglomerate hydrophilic particles.

Gas bubbles, composed of gases such as oxygen, nitrogen or carbon dioxide etc. are known to act as effective promoters of hydrophobicity. These gas bubbles can be attached to the hydrophobic particles in the coal-water slurry prior to the agglomeration step. The presence of the gas bubbles leads to more effective and faster agglomeration.

The novel binding agent described above (the concentrated water in oil emulsion) could be coated with fine gas bubbles rather than with low viscosity oil. This would be done by nucleating air bubbles onto the tiny portions of the novel binding agent, or using an air sparger and colliding the gas bubbles with the novel binding agent in an agitated tank. Again, this addition of the gas bubbles will promote more effective and faster agglomeration with the coal.

An alternative binding agent could also be formed using an air in oil emulsion, essentially a foam. Ideally, the air bubbles would need to be exceedingly fine, space filling and stabilised by a surfactant. In this case, an air sparger would ideally be used to form bubbles in oil, however, nucleation of dissolved gas could also be used to produce the foam.

Similarly, the foam described above could be used to produce a foam-like coating around the novel binding agent (the concentrated water in oil emulsion). This would then promote more effective and faster agglomeration with the coal particles.

The invention claimed is:

1. A method of agglomerating fine particles including the steps of:

providing a solution of oil and emulsifying agent, progressively dispersing water into said solution, and forming a concentrated water in oil emulsion with stabilized water drops packed inside the oil phase, the emulsion comprising a highly viscous, sticky oil-like medium and having a homogeneous appearance, and adding the concentrated water in oil emulsion to a slurry of fine particles, wherein the sticky oil-like medium acts as a binding agent, causing the fine particles to collide and stick to the sticky oil-like medium, thereby agglomerating at least a portion of the fine particles from the slurry while keeping the stabilized water drops within the oil phase.

2. A method as claimed in claim 1, further comprising the step of adding the concentrated water in oil emulsion to a larger volume of agitated water until the concentrated water in oil emulsion is dispersed into the larger volume.

3. A method as claimed in claim 2, wherein the fine particles are liquid particles.

4. A method as claimed in claim 2, wherein the concentrated water in oil emulsion is dispersed into smaller portions of concentrated water in oil emulsion surrounded by the larger volume of water.

5. A method as claimed in claim 4, wherein the fine particles are liquid particles.

6. A method as claimed in claim 1, wherein the fine particles are solid fine particles.

7. A method as claimed in claim 6, wherein the fine particles are fine coal particles.

8. A method as claimed in claim 6, wherein the fine particles are mineral particles.

9. A method as claimed in claim 1, wherein the fine particles are liquid particles.

10. A method as claimed in claim 1, wherein the concentrated water in oil emulsion has a water volume fraction greater than 0.75.

11. A method as claimed in claim 10, wherein the water volume fraction is greater than 0.9.

12. A method as claimed in claim 1, wherein tiny portions of the stabilised water drops packed inside the oil phase in the concentrated water in oil emulsion are coated with a new thin film of low viscosity oil, reducing the stickiness and increasing the hydrophobicity of the sticky oil-like medium.

13. A method as claimed in claim 1, wherein a chemical collector or gas bubbles are attached to the surface of the fine particles to improve hydrophobicity.

14. A method as claimed in claim 1, wherein gas bubbles are added to the oil solution to form a foam-like binding agent.

15. A method as claimed in claim 1, wherein the agglomerated fine particles stuck to the sticky oil-like medium float to the surface of the water for easy removal.

16. A method as claimed in claim 1, wherein the agglomerated fine particles stuck to the sticky oil-like medium are passed over a screen to dewater and/or deslime the agglomerates.

17. A method as claimed in claim 1, wherein said slurry is an aqueous slurry.

18. The method of claim 1, wherein the concentrated water in oil emulsion is hydrophobic and wherein the fine particles are hydrophobic.

19. A method of agglomerating fine particles including the steps of:

providing a solution of oil and emulsifying agent, progressively dispersing water into said solution, and forming a concentrated water in oil emulsion with stabilized water drops packed inside the oil phase, the emulsion comprising a highly viscous, sticky oil-like medium and having a homogeneous appearance, and adding a slurry of fine solid particles in a slurry to the concentrated water in oil emulsion, wherein the sticky oil-like medium acts as a binding agent, causing the fine particles to collide and stick to the sticky oil-like medium while keeping the stabilized water drops within the oil phase, thereby agglomerating at least a portion of the fine particles from the slurry and separating at least a portion of the fine particles from the slurry.

20. A method of agglomerating fine particles including the steps of:

providing a solution of oil and emulsifying agent, progressively dispersing water into said solution, and forming a concentrated water in oil emulsion with stabilized water drops packed inside the oil phase, the emulsion comprising a highly viscous, sticky oil-like medium and having a homogeneous appearance, and adding a slurry of fine particles to the concentrated water in oil emulsion, wherein the sticky oil-like medium acts as a binding agent, causing the fine particles to collide and stick to the sticky oil-like medium without releasing the stabilized water drops from within the oil phase, thereby agglomerating at least a portion of the fine particles from the slurry.

* * * * *